US006310335B1

(12) United States Patent
Bonnet et al.

(10) Patent No.: US 6,310,335 B1
(45) Date of Patent: Oct. 30, 2001

(54) TRANSLATIONAL BRAKING DEVICE FOR A PROJECTILE DURING ITS TRAJECTORY

(75) Inventors: Alain Bonnet; Anne-Laure Cros, both of Bourges (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 09/450,689

(22) Filed: Nov. 30, 1999

(30) Foreign Application Priority Data

Nov. 30, 1998 (FR) ..... 98 15101

(51) Int. Cl.[7] ..... F41G 7/00; F41G 9/00; F42B 10/00; F42B 15/01; F42B 15/10; F42B 15/20; F42B 15/22; F42B 10/14; F42B 10/48

(52) U.S. Cl. ..... 244/3.1; 244/3.24; 244/3.27; 244/3.29

(58) Field of Search ..... 244/3.1, 3.21, 244/3.24, 3.25, 3.26, 3.27, 3.28, 3.29, 110 D, 113; 102/293, 388, 386

(56) References Cited

U.S. PATENT DOCUMENTS

| | | | | |
|---|---|---|---|---|
| 17,312 | * | 5/1857 | Brand | 244/3.29 |
| 1,300,708 | * | 4/1919 | Edison | 244/3.27 |
| 2,271,280 | * | 1/1942 | Weinert | 102/376 |
| 2,793,591 | * | 5/1957 | Jasse | 244/3.29 |
| 2,840,326 | | 6/1958 | Richardson et al. | 244/113 |
| 3,188,958 | | 6/1965 | Burke et al. | 244/3.14 |
| 3,768,755 | | 10/1973 | Prochnow et al. | 244/3.24 |
| 3,986,683 | | 10/1976 | Ellison | 244/3.21 |
| 4,113,204 | | 9/1978 | Leek | 244/3.21 |
| 4,856,737 | * | 8/1989 | Zacharin | 244/113 |
| 5,762,291 | * | 6/1998 | Hollis et al. | 244/3.24 |
| 5,816,531 | * | 10/1998 | Hollis et al. | 244/3.27 |
| 5,826,821 | | 10/1998 | Brandon et al. | 244/3.27 |

FOREIGN PATENT DOCUMENTS

| | | | |
|---|---|---|---|
| 0 138 942 B1 | 5/1985 | (EP) | F41G/9/00 |
| 0 252 036 A2 | 1/1988 | (EP) | F42B/13/50 |
| 496912 | 8/1919 | (FR) . | |
| WO 98/01719 | 1/1998 | (WO) | F42B/10/50 |

* cited by examiner

*Primary Examiner*—Charles T. Jordan
*Assistant Examiner*—Christian M. Best
(74) *Attorney, Agent, or Firm*—Oliff & Berridge, PLC

(57) ABSTRACT

The subject of the invention is a translational braking device for a projectile during its trajectory comprising at least two airbrakes that are radially deployable so as to increase the projectile's aerodynamic drag. Each airbrake is a flap pivoting around a pivot integral with the projectile and parallel to its axis. The device incorporates at least one pyrotechnic piston locking at least one of the flaps in its folded position and at least two flaps are stacked one on top of the other when they are in their folded position, at least a first of the two flaps incorporates a mechanism to retain the second of the two flaps in its folded position.

19 Claims, 10 Drawing Sheets

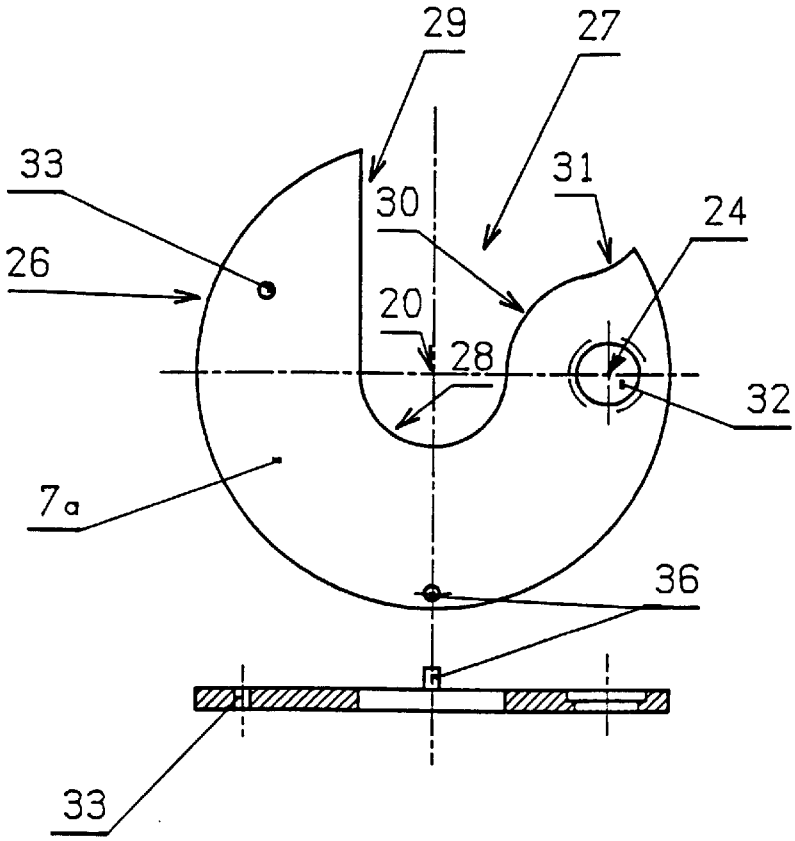
FIG. 5a
FIG. 5b
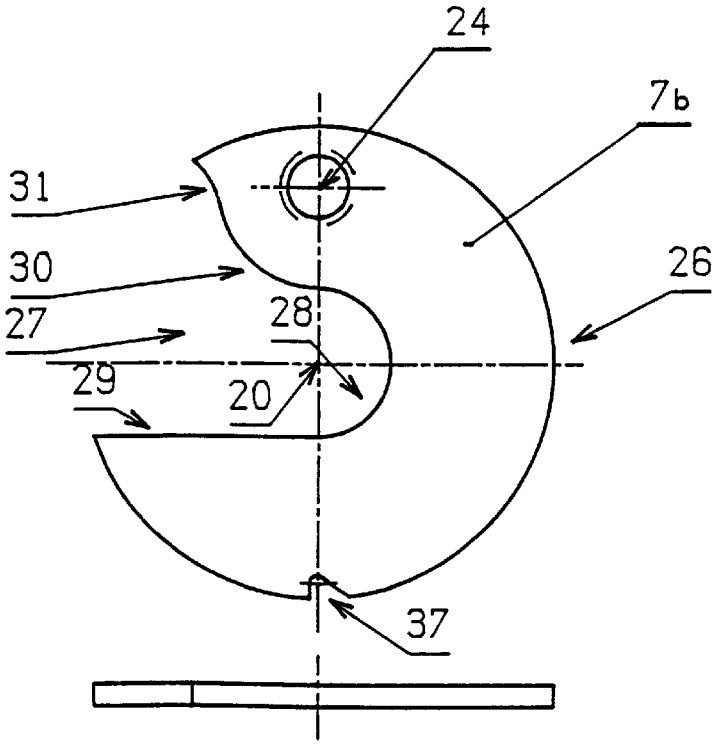
FIG. 5c
FIG. 5d

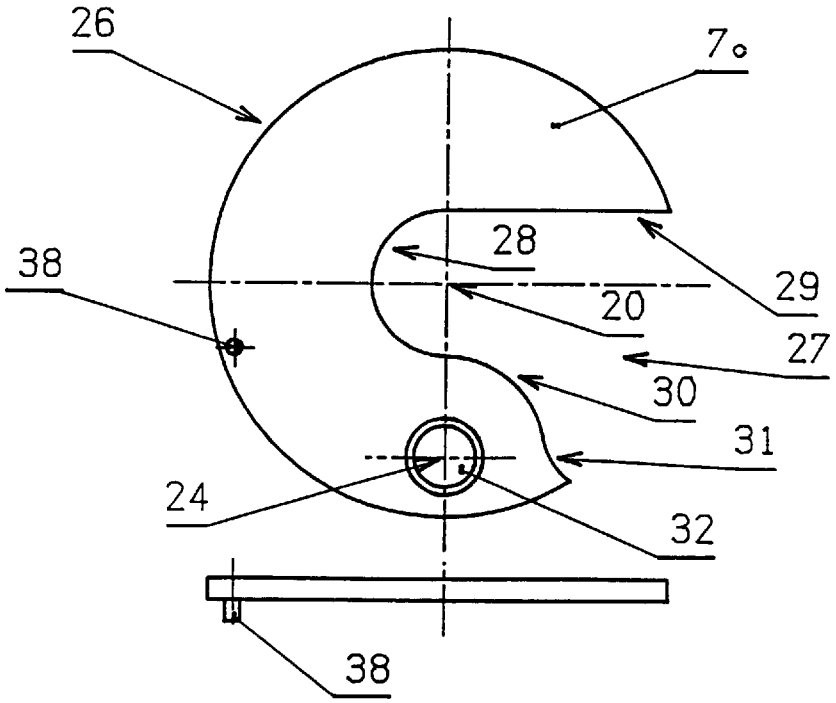
FIG. 5e
FIG. 5f
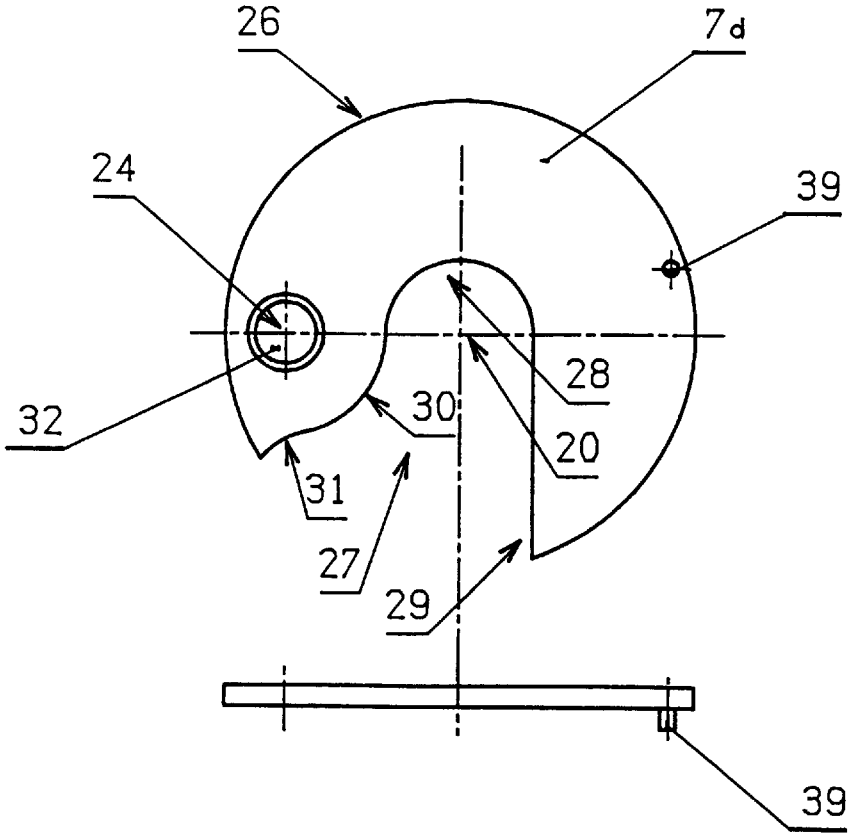
FIG. 5g
FIG. 5h

TRANSLATIONAL BRAKING DEVICE FOR A PROJECTILE DURING ITS TRAJECTORY

BACKGROUND OF THE INVENTION

The technical scope of the invention is that of translational braking devices for a projectile during its trajectory.

Such devices are notably known in the field of artillery.

Patent EP138942thus describes an artillery projectile that incorporates a device to brake the nose cone whose deployment is controlled during the trajectory.

Such an arrangement allows firing accuracy of artillery fires to be increased whilst taking into account dispersions due to the variations in initial velocity of the projectile. Indeed, it is thus possible to lay the weapon so as to fire beyond the target aimed at, a fire control measures the real velocity of the projectile at the muzzle of the weapon and a braking command is thereafter transmitted to the projectile so as to reduce its range and thus bring it to the desired point of impact.

The braking device described by this patent comprises, either radially mobile fingers, or a plane frontal surface. The surface area of these braking means with respect to the section of the projectile is too small for their braking capacity to be sufficient.

Patent WO98/01719 describes another braking device for a projectile. This device comprises four airbrake plates stacked one on top of the other and radially mobile with respect to the projectile.

The braking area is thus substantially increased (it constitutes approximately double the section of the projectile) and is of a reduced bulk inside the projectile body.

However, this device has drawbacks.

The shapes of the plates are complicated to machine, they also incorporate numerous indents that reduce their mechanical strength, notably in their fully deployed position where the stresses are at their worst.

Moreover, the plates are unlocked by means of two gas generators that displace two retention pins, each pin immobilizing two plates. Such a structure is likely to cause dissymmetries or sticking when the plates are deploying that risk modifying the trajectory of the projectile in a non-reproducible manner.

SUMMARY OF THE INVENTION

The aim of the invention is to propose a translational braking device for a projectile that does not have such drawbacks.

Thus the braking device according to the invention is of a simple inexpensive design and has improved mechanical strength with respect to the previously described device.

It is not likely to stick, and it consequently has perfect opening symmetry of the airbrakes.

Thus, the subject of the invention is a translational braking device for a projectile during its trajectory comprising at least two airbrakes that are radially deployable so as to increase the projectile's aerodynamic drag, wherein each airbrake is a flap pivoting around a pivot integral with the projectile and parallel to its axis.

According to one characteristic of the invention, the braking device incorporates at least one pyrotechnic piston locking at least one of the flaps in its folded position.

According to a first embodiment of the invention, at least two flaps are stacked one on top of the other when they are in their folded position, at least a first of the two flaps incorporating means to retain the second of the two flaps in its folded position.

The braking device can, advantageously, incorporate at least four flaps, a first flap being locked by the pyrotechnic piston and carrying a first pin retaining a second flap in its folded position, a third flap carrying a second pin co-operating with a first retention surface integral with the second flap, a fourth flap carrying a third pin co-operating with a second retention surface integral with the third flap, a single pyrotechnic piston thereby ensuring the locking of all four flaps.

Each flap can have an external profile covering the arc of a circle whose diameter is substantially equal to that of an external part of the projectile and an indent intended to allow the flap to fold around an axial support integral with the projectile.

Each flap can, advantageously, incorporate an abutment heel intended to co-operate with a matching surface of the axial support so as to stop the opening movement of the flap.

The arc length of the external profile of each flap and the length of the different heels can be selected such that, in the deployed position, the free end of at least one flap presses on a neighboring flap or else on the projectile.

The axial supports can carry two plates, a lower plate and an upper plate, each plate supporting at least two pivots of the flaps that are thus arranged between the two plates when they are in the folded position.

According to a second embodiment of the invention, each flap can incorporate a toothed circular portion arranged around the pivot , such portion meshing with a central pinion coaxial to the projectile, such central pinion thereby joining together the different flaps.

The pyrotechnic piston can, advantageously, lock the central pinion.

The flaps can, in any case, be integral with a nose cone fuse of the projectile.

BRIEF DESCRIPTION OF THE DRAWINGS

Other advantages of the invention will become apparent from reading the following description of the different embodiments, such description being made with reference to the appended drawings, in which:

FIGS. 5*a* to 5*h* show the braking flaps alone, FIGS. 5*a*, 5*c*, 5*e*, and 5*g* being frontal views of said flaps and FIGS. 5*b*, 5*d*, 5*f*, and 5*h* being lateral views of the different flaps, each of the frontal views being associated with its lateral view for a given flap (5*a*/5*b*, 5*c*/5*d*, 5*e*/5*f* and 5*g*/5*h*)

DETAILED DESCRIPTION OF THE PREFERRED EMBODIMENTS

Figure 1:
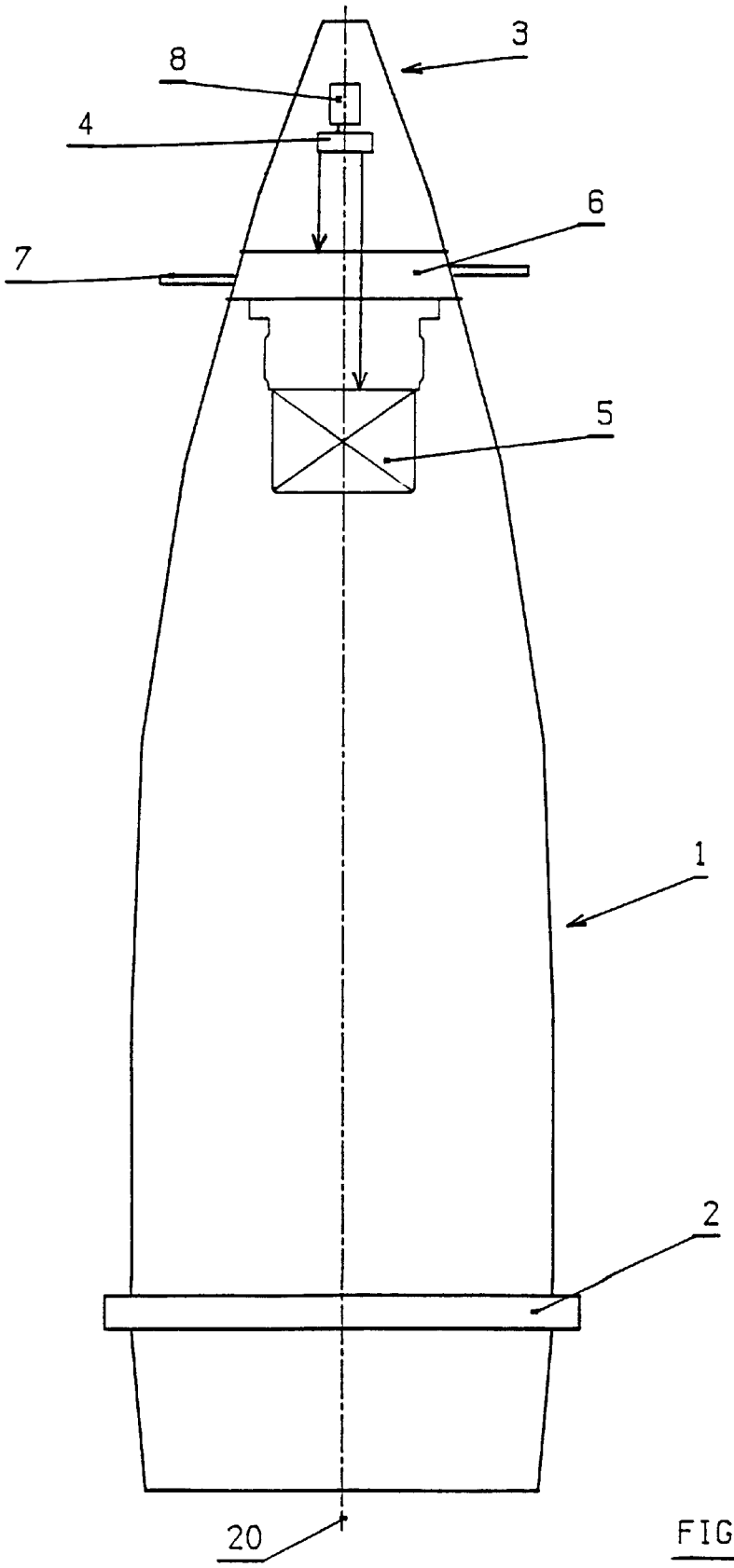
FIG. 1 schematically shows a projectile fitted with a braking device according to the invention.

With reference to FIG. 1, an artillery projectile 1 is fitted, at its rear part, with a belt 2 intended to mesh in the rifling of a weapon barrel (not shown) and to provide sealing against the propellant gases when the projectile is fired. At its front part this projectile carries a fuse 3 that is intended, in a conventional manner and according to the type of projectile in question (explosive projectile or carrier projectile), to ensure either the ignition of an explosive charge placed inside the projectile, or the priming of a gas-generating charge intended to eject a payload during the trajectory that has been placed inside the projectile (anti-tank ammunition or grenades).

To this end, the fuse 3 incorporates an electronic control device 4 that causes the ignition of a pyrotechnic charge 5 (that, according to the case, is a detonation relay or a gas generator).

In accordance with the invention, this fuse 3 also incorporates a translational braking device 6 enabling the radial deployment during the trajectory of braking flaps 7. The deployment of the flaps 7 is controlled by the electronic control device 4 in response to a command received during the trajectory by means of a receiver 8 or else emitted by the electronic control device 4 in accordance with programming made before firing, or else modified in the first moments following firing to take into account the real initial velocity of the projectile.

Programming during the trajectory will be ensured by means of a receiver 8 that can use radar technology.

Figure 2:
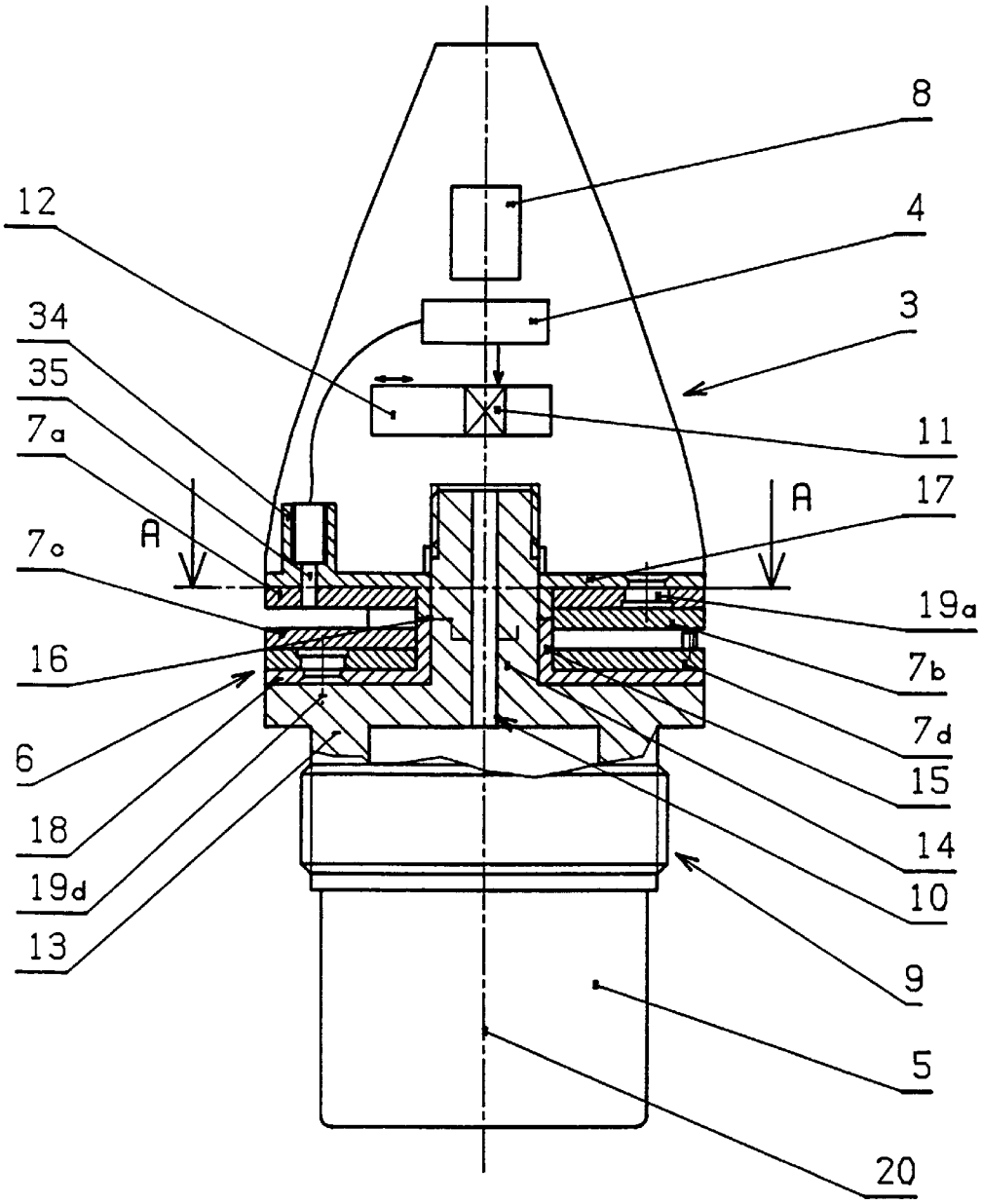
FIG. 2 shows a partial longitudinal section view of a projectile fuse fitted with a braking device according to a first embodiment of the invention.

FIG. 2 shows the fuse 3 in more detail. It has an overall shape and bulk analogous to those of conventional artillery fuses. It incorporates a body 13 onto which threading 9 is made that is intended to allow it to be made integral with the projectile. The pyrotechnic charge 5 is placed in a bush integral with the body and communicates via a priming channel 10 with an electrically-operated igniting composition 11 (primer or squib), that is itself connected to the electronic control device 4.

In a conventional manner neither described nor shown in detail here, the igniting component 11 is carried by a mobile flap 12 of a safety and arming device.

The body 13 of the fuse 3 incorporates an axial cylinder 14 that connects a lower portion of the fuse 3 incorporating the pyrotechnic charge 5 and an upper portion of the fuse 3 enclosing the electronic device 4. A priming channel 10 passes through this cylinder. The cylinder 14 receives the braking device 6 that comprises an axial fin support 15 incorporating a tubular part 16 and two plates 17 and 18. The tubular part 16 is mounted coaxially to the cylinder 14 and thus has an inner diameter that is equal to that of the cylinder 14. The upper 17 and lower 18 plates are plane and perpendicular to the axis 20 of the fuse 3 and the projectile. The two plates 17 and 18 delimit a ring-shaped volume inside which flaps 7 are placed. The fin support 15 is made integral in translation and in rotation with the fuse 3 body, for example by a locking nut mounted on the cylinder 14 and not shown.

In accordance with this first embodiment of the invention, which is also the preferred embodiment, four flaps 7*a*, 7*b*, 7*c* and 7*d* are integral with the support 15.

Each flap is hinged with respect to the support around a pivot 19 (19*a*, 19*b*, 19*c*, 19*d*) parallel to the axis 20 of the fuse 3 (and thus also of the projectile).

For reasons of clearness in the drawing, the pivots 19 are only shown schematically in FIG. 2. The upper plate 17 carries two pivots 19*a* and 19*b* that fasten the two flaps 7*a* and 7*b*. The lower plate 18 carries two pivots 19*c* and 19*d* that fasten the two pivots 7*c* and 7*d*. The pivots are evenly spaced angularly around the axis 20 of the fuse 3.

The different flaps are stacked on top of one another when they are in their folded position, the first flap 7*a* is in contact with the upper plate 17 and the fourth flap 7*d* is in contact with the lower plate 18. The second flap 7*b* is placed between the first flap 7*a* and the third flap 7*c*, said flap 7*c* being itself placed between the second flap 7*b* and the fourth flap 7*d*. Such an arrangement of the flaps ensures their mechanical resistance to the acceleration developed when the projectile is fired.

Figure 6:
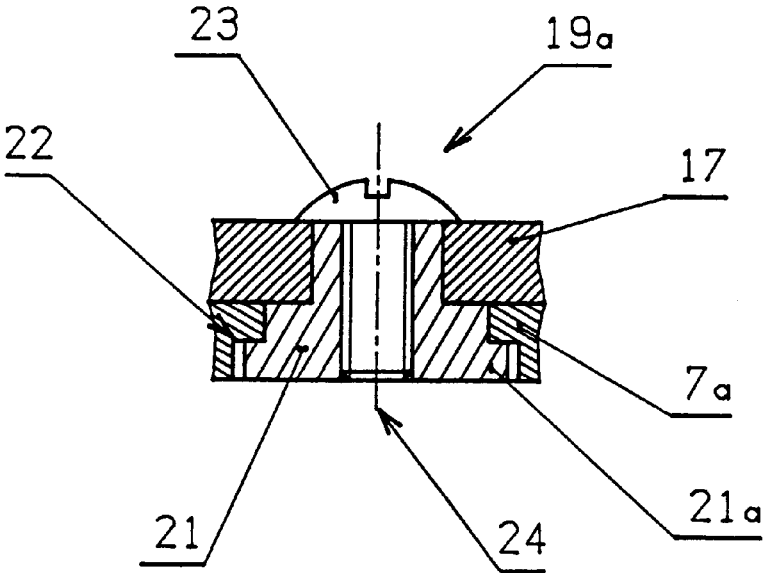
FIGS. 6 and 7 are partial section views of two types of flap hinges.
Figure 7:
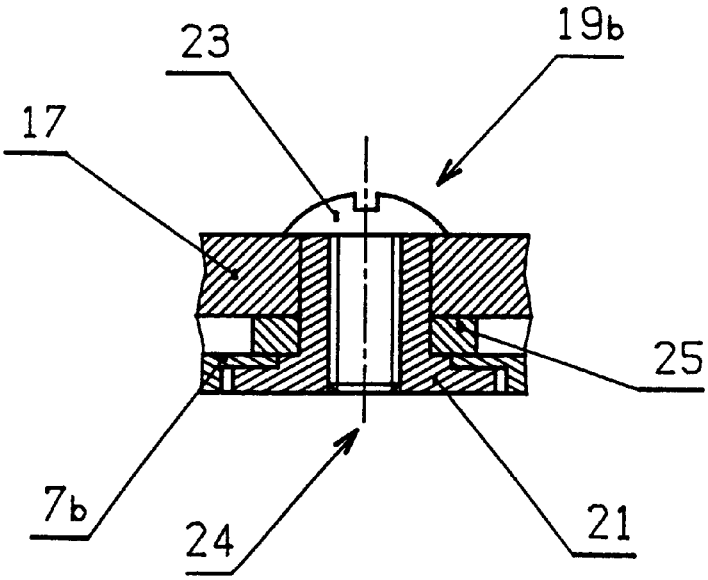

FIGS. 6 and 7 show the structure of a pivot 19 in detail. FIG. 6 shows the structure of a pivot (19*a* or 19*d*) fastening the flaps that are directly in contact with plates 17 and 18, that is flaps 7*a* and 7*d*. Pivot 19*a* (or 19*d*) is constituted by a nut 21 having an enlarged head 21*a* housed in a counter-sink 22 arranged in the flap. A screw 23 has its head in contact with the plate 17 (or 18) and connects the flap and the plate. Play of around a tenth of a millimeter is provided during assembly so as to allow the flap to pivot around hinge pin 24 of pivot 19.

FIG. 7 shows the structure of a pivot (19*b* or 19*c*) fastening the flaps that are not directly in contact with the plates 17 and 18, that is flaps 7*b* and 7*c*.

This pivot also incorporates a nut 21 whose enlarged head is housed in a counter-sink arranged in the flap and a screw 23 whose head is in contact with the plate 17 (or 18). It differs from the pivot in FIG. 6 by the presence of a brace 25 ensuring a space between the plate and the flap in question. The thickness of the brace is equal to that of the flap placed between the plate and the intermediate flap in question.

The flaps can be seen in greater detail in FIGS. 5*a* to 5*h*. Each flap is made, for example, of steel sheeting of a thickness of 2 mm and that has a perforation 32 intended to receive the pivot 19 and in which is arranged a counter-sink 22. The flaps can also be made of another material, for example a light alloy (aluminum-based).

Each flap has an external profile 26 covering the arc of a circle whose diameter is substantially equal to the external diameter of the fuse 3.

Each flap also has an indent 27 intended to allow the flap to be folded around the tubular part 16 of the axial support 15. To this end, the indent 27 incorporates a hemicylindrical portion 28 of the same diameter as that of the tubular part 16 and coaxial to its axis 20 (that is coaxial also to the axis of the fuse 3 and the projectile). The hemicylindrical portion 28 of the indent is connected on one side to a plane surface 29 that is perpendicular to the plane defined by the hinge pin 24 of the pivot 19 in question and the axis 20 of the fuse 3, and on the other to two cylindrical surfaces 30 and 31, the first (30) of which is coaxial to the pivot 19 and the second (31) having an axis parallel to that of the pivot and a radius equal to that of the tubular part 16. The surface 31 constitutes an abutment heel that is intended to co-operate with the axial support 15 to stop the opening movement of the flap 7.

The cylindrical surfaces 30 and 31 are arranged in the vicinity of the pivot 19 and the axis 20 of the fuse 3 is located between the hinge pin 24 of the pivot and the plane surface 29. This results in such an arrangement that a pivotal movement of each flap around its hinge pin 24 is allowed without there being any interference between the plane surface 29 and the tubular part 16. As a result of the shape thus adopted for the flaps, a maximal flap surface area is obtained for a minimal bulk in the folded position.

In addition, the different flaps have certain structural differences with respect to one another.

Thus, the first flap 7*a* has a hole 33 that is intended to receive the rod 35 of a pyrotechnic piston 34 (see FIG. 2).

This pyrotechnic piston is in this case a pyrotechnic retractor that comprises a gas-generating composition electrically ignited by the control device 4 and whose effect is to cause the retraction of the rod 35 from the hole 33. Such a pyrotechnic component is well known to the expert and will therefore not be described here in any further detail.

The rod 35 of the retractor locks the first flap 7*a* in its folded position.

The first flap 7*a* also has a first pin 36 that is intended to ensure the retention of the second flap 7*b* in its folded position. To this end, it co-operates with a notch 37 made on the external circular profile 26 of the second flap 7*b*.

The third flap 7*c* has a second pin 38 that is intended to co-operate with the plane surface 29 of the second flap 7*b* when this is in its folded position. This plane surface then constitutes a first retention surface that prevents the third flap from opening when the second flap is in the folded position.

Lastly, the fourth flap 7*d* has a third pin 39 that co-operates in an analogous manner with the plane surface 29 of the third flap 7*c* when this is in its folded position. This plane surface constitutes a second retention surface that prevents the fourth flap from opening when the third flap is in its folded position.

Thus, a single pyrotechnic piston 34 locks all the four flaps 7*a*, 7*b*, 7*c* and 7*d* and prevents them from deploying further to the centrifugal forces that are exerted on them when the projectile is fired.

Pins 36, 38 and 39 are constituted by small cylindrical rods mounted in holes made in the flaps.

Figure 3:
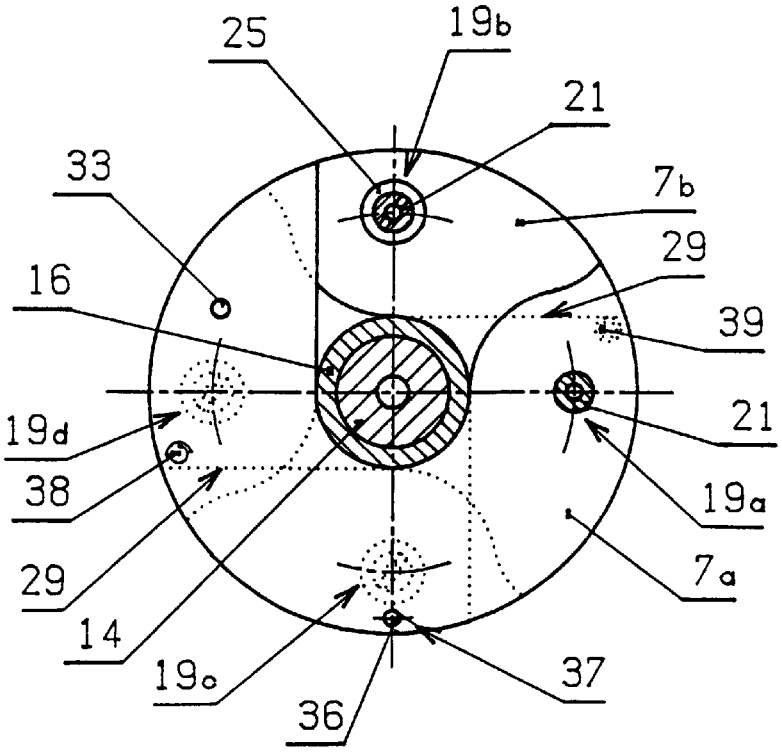
FIG. 3 shows this same device in the folded position and as a section along plane AA referenced in FIG. 2.

FIG. 3 shows the four flaps in the folded locked position.

The section view of the fuse 3 has been carried out so as to remove the upper plate 17. Only the first flap 7*a* is fully visible, its pivot 19*a* being to the right of the figure with the nut 21 sectioned. The second flap 7*b* is partially visible in the indent of the first flap, its pivot 19*b* is at the top of the figure with the sectioned nut 21 and the brace 25 visible. The third flap is hidden, its pivot 19*c* is at the bottom of the figure, the fourth flap is also hidden, its pivot 19*d* is at the left of the figure.

This figure shows how the different retention means co-operate to lock the four flaps.

We can thus see that, when the first flap 7*a* is immobilized by the rod 35 of the pyrotechnic piston introduced in the hole 33, the pin 36 of the first flap is positioned in the notch 37 of the second flap 7*b*, which can no longer deploy.

The pin 38 carried by the third flap 7*c* is in contact with the plane surface 29 of the second flap 7*b*. The third flap is therefore not able to open.

The pin 39 carried by the fourth flap 7*d* is in contact with the plane surface 29 of the third flap 7*c*. The fourth flap is therefore not able to open.

At a given moment during the trajectory, the electronic control device 4 will cause the rod 35 to retract from the pyrotechnic piston. The first flap 7*a* will open under the action of the centrifugal force. The pin 36 thereafter comes out of the notch 37 freeing the second flap 7*b*, which can now also open. The surface 29 moves away from the pin 38, thereby freeing the third flap 7*c*, which in turn opens freeing the fourth flap 7*d*.

Because only one locking device (the pyrotechnic piston) is employed, the four flaps open practically simultaneously. This results in a symmetry and reproducibility of the opening movement that avoids disturbances to the braking trajectory of the projectile.

Figure 4:
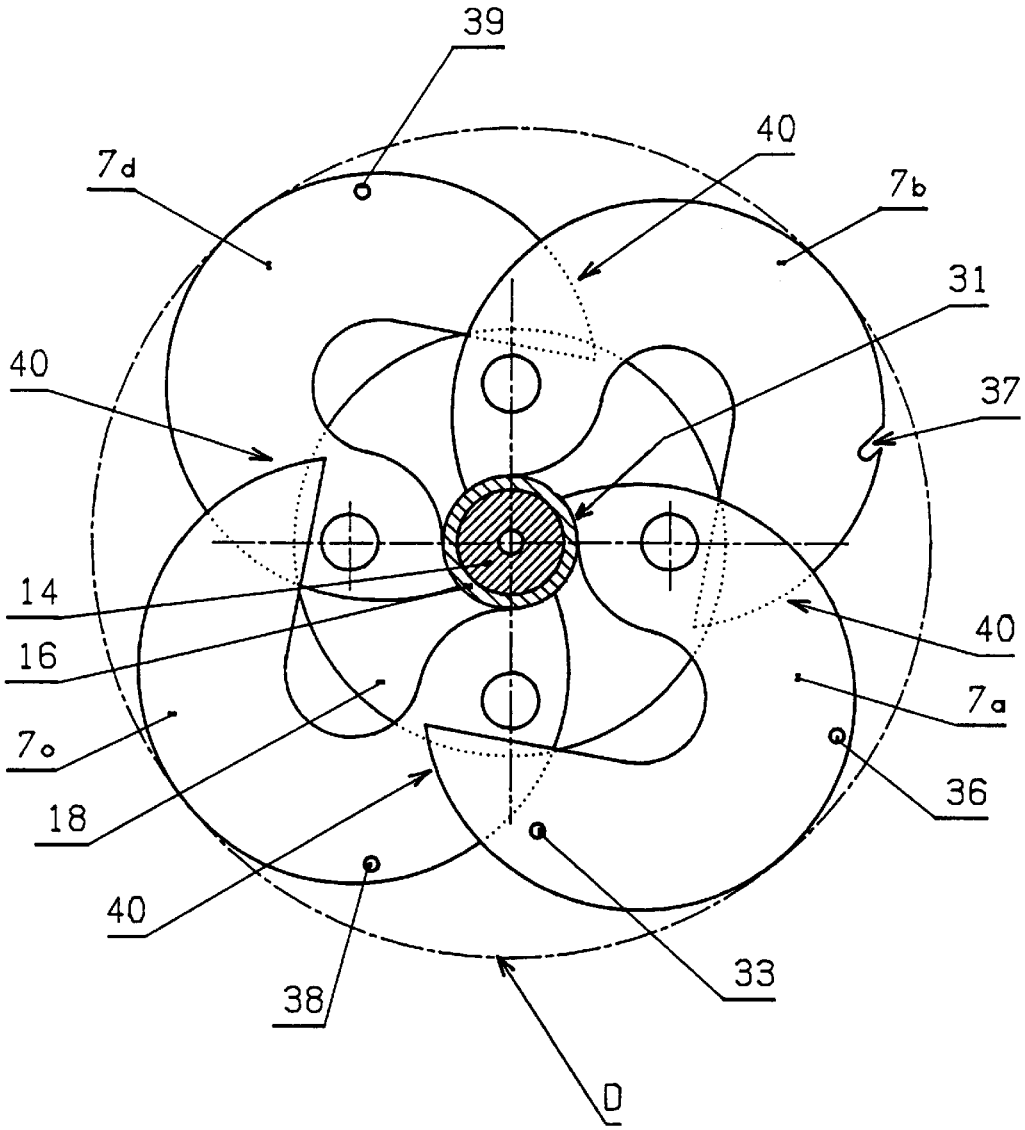
FIG. 4 is an analogous view to FIG. 3 but shows the device in the deployed position.

FIG. 4 shows the flaps in their deployed position.

The rotation of each flap is halted by its abutment heel 31 coming into contact with the tubular part 16 of the axial support 15. Such an arrangement enables the angle of opening of the flaps to be controlled.

The arc length of the external profile 26 of each flap and the length of the different abutment heels are selected such that, in the deployed position, the free end 40 of each flap (the end that is the furthest away from the pivot 19) presses on or lies opposite to a neighboring flap or else presses on or lies opposite to the lower plate 18 (that forms a bearing surface integral with the fuse and thus with the projectile, perpendicular to the projectile axis).

In this example, however, the fourth flap 7*d* presses by its free end 40 on the lower plate 18. The third flap 7*c* presses by its end 40 on the fourth flap 7*d* and opposite plate 18 increasing the rigidity of the bearing. The first and second flaps have their free end respectively opposite the third flap and the lower plate 18.

By reducing the opening amplitude of the flaps in this manner, the rigidity of the braking device in its deployed position is improved, and therefore also its mechanical bending strength.

The opening diameter D obtained is around 118 mm for an initial diameter of the lower plate of around 61 mm, which represents an increase in the diameter of around 90%.

The device according to the invention is thus seen to obtain a substantial, rigid braking surface with a reduced bulk and substantial mechanical strength.

Different variants are possible without departing from the scope of the invention.

It is thus possible to vary the number of flaps, their shape and their opening angle.

Figure 8:
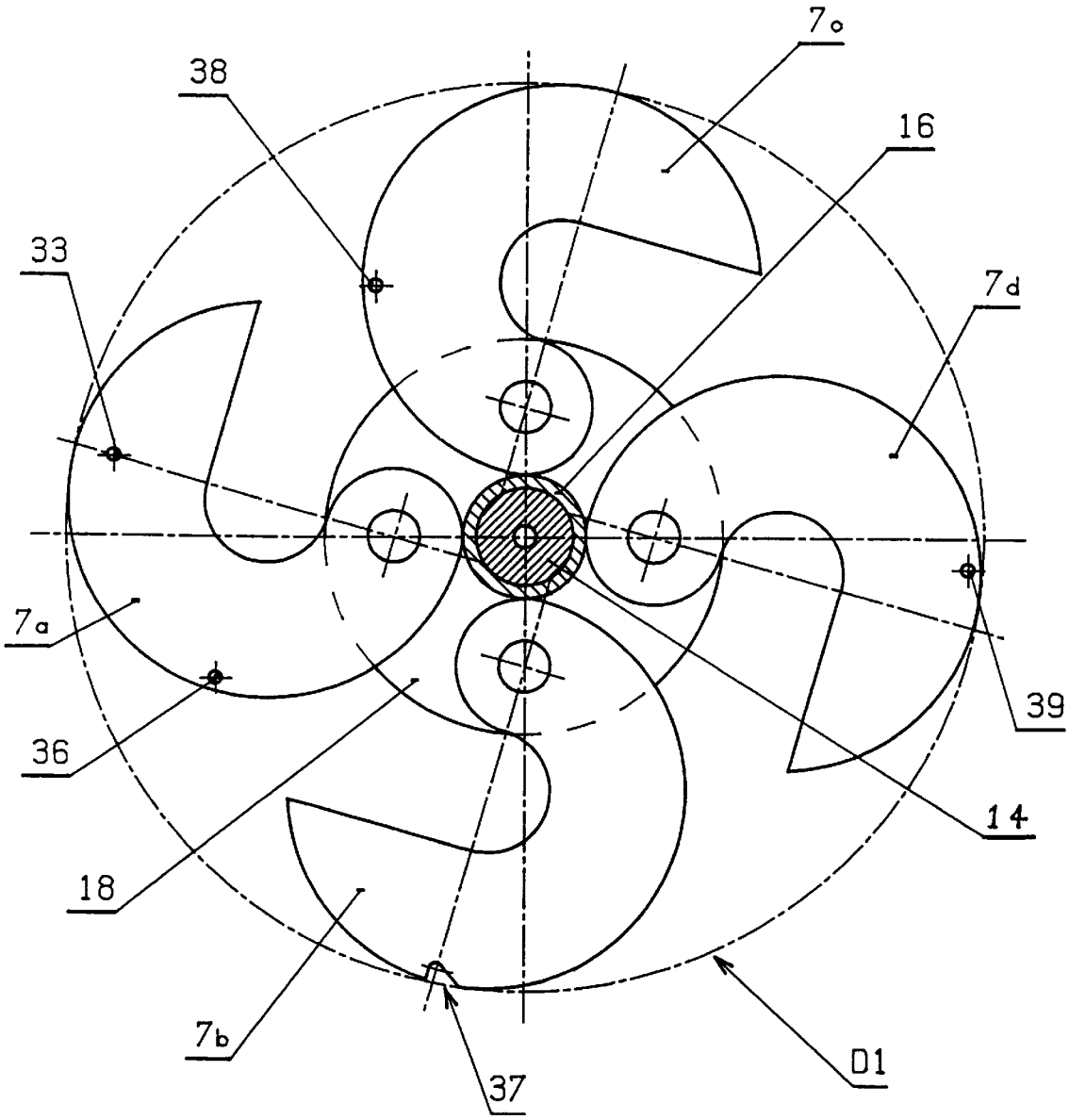
FIG. 8 shows a section view in the deployed position of a device according to a first embodiment.

FIG. 8 shows a variant in which the flaps 7 are without the abutment heel. They are therefore able to deploy fully under the effect of the centrifugal force and allow a maximal opening diameter $D_1$ of around 140 mm to be obtained from an initial diameter of around 61 mm.

However, the free ends of the flaps are neither pressing on nor opposite another flap or the lower plate. This leads to bending of the flaps and less structural rigidity for the device.

Figure 9:
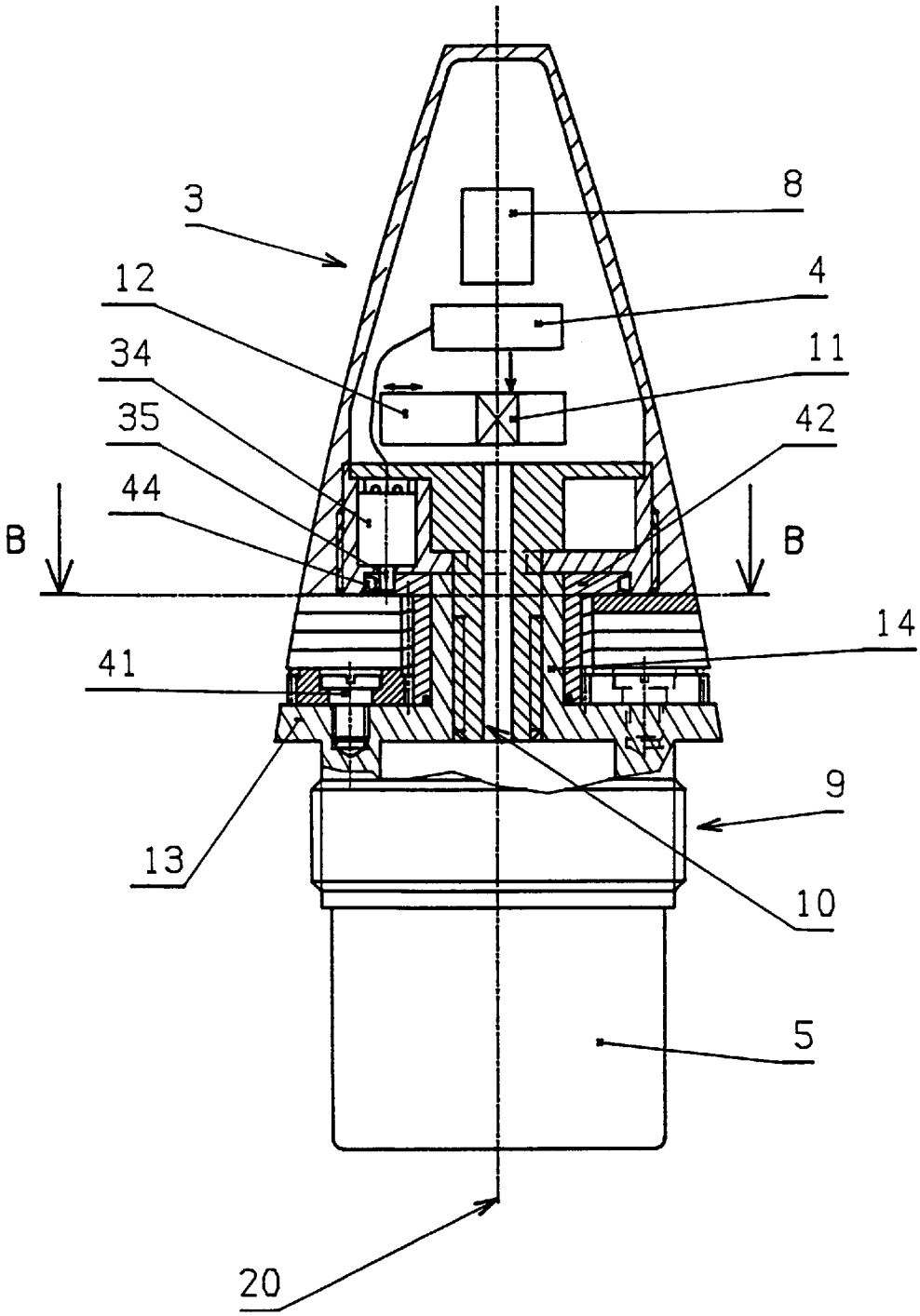
FIG. 9 shows a partial longitudinal section view of a projectile fuse fitted with a braking device according to a second embodiment of the invention.
Figure 10:
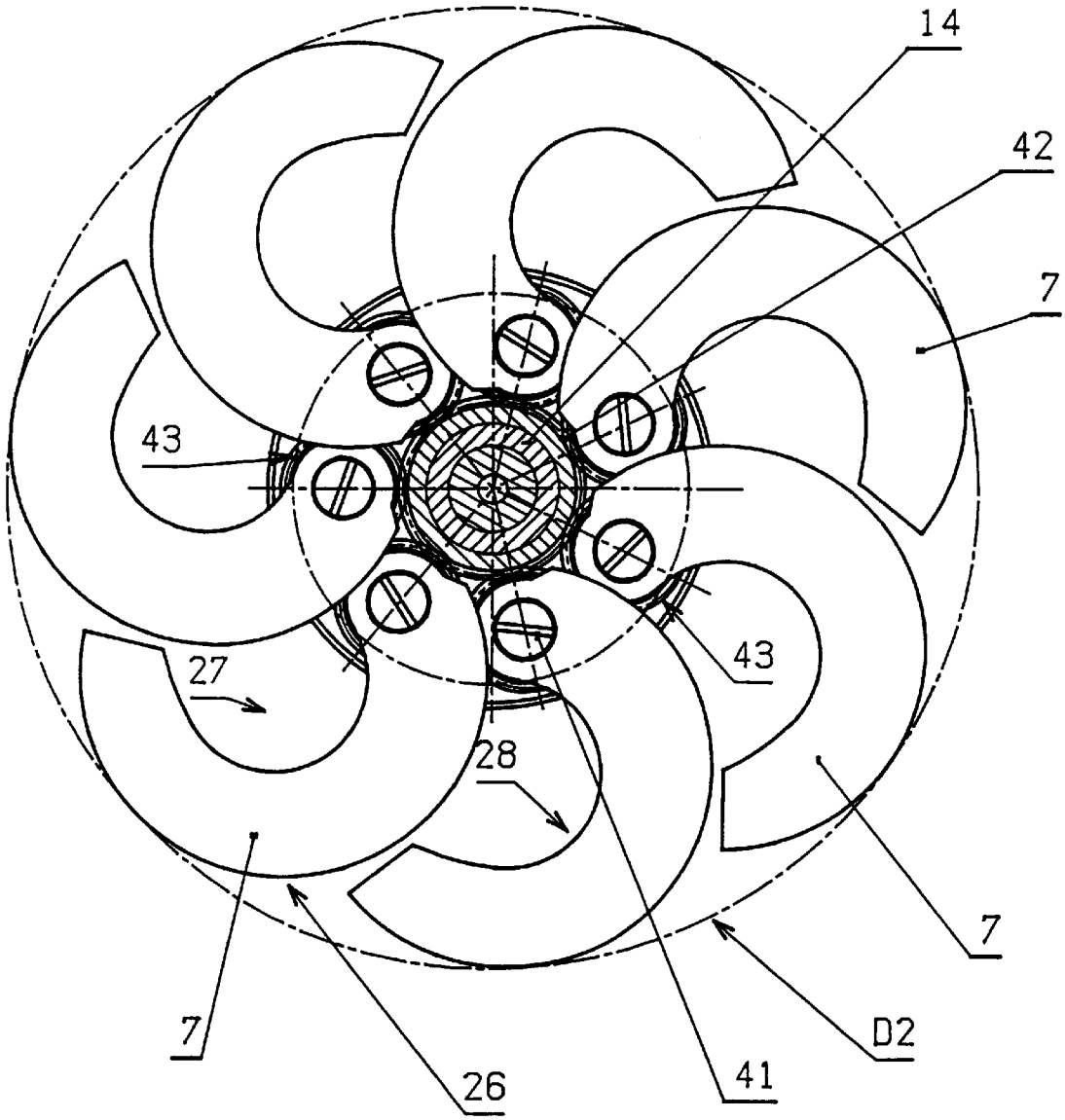
FIG. 10 shows this same device in the deployed position and as a section along plane BB referenced on FIG. 9.

FIGS. 9 and 10 show a second embodiment of the invention.

This embodiment differs from the previous ones in that all the flaps 7 are fastened onto the body 13 by screws 41 that constitute the flap pivots. Seven flaps 7 are provided and are stacked on top of one another in the folded position (FIG. 9). So as to allow each flap to be fastened to the body 13, screws 41 of different lengths are provided for each flap as well as suitable braces (not shown).

Each flap 7 is constituted by a piece of steel sheeting that has an external profile 26 covering an arc of a circle whose diameter is substantially equal to the external diameter of the fuse.

Each flap 7 also has an indent 27 comprising a hemicylindrical portion 28 intended to allow the flap to fold around the axial cylinder 14 integral with the fuse body 13 and coaxial to its axis 20 (that is also coaxial to the fuse and the projectile).

According to this embodiment, a central cylindrical pinion 42 is mounted coaxially to the axial cylinder 14 and is free to rotate with respect to said cylinder. The teeth of the pinion are parallel to the axis 20 of the fuse and mesh with toothed circular portions 43 made on all the flaps 7 and coaxial with their pivot 41.

Thus a rotation of the central pinion 42 around the axis 20 of the fuse makes all the flaps 7 either deploy or fold up (according to the selected rotational direction).

Such an arrangement ensures a symmetry of the opening movements of all the flaps 7.

The central pinion 42 incorporates an upper flange 44 in which a hole has been made into which the rod 35 of the pyrotechnic piston 34 is housed thereby immobilizing the central pinion 42 in rotation, and thus locking all the flaps in their folded position against the effects of the centrifugal force.

This device operates as follows:

At a given moment during the trajectory, the electronic control device will ignite the pyrotechnic piston 34. The rod 35 is extracted from its hole in the flange 44 of the pinion 42 thus unlocking it. The centrifugal force exerted on the flaps will cause them to open, such opening being symmetrical with respect to the axis 20 of the projectile because of the presence of the toothed portions 43 and central pinion 42. The flaps continue to open until reaching the position shown in FIG. 10 in which the flaps abut against the central pinion.

It is possible for the opening angle of the different flaps to be controlled by acting on the length of their toothed circular portion. The opening of a flap can not continue beyond the possible relative course of this toothed portion on the central pinion.

Opening diameter $D_2$ that can be obtained with this embodiment of the invention is of around 130 mm from an initial diameter of around 61 mm.

The invention can naturally be applied to all types of large-caliber projectiles (over 50 mm) or medium-caliber projectiles (less than or equal to 50 mm).

What we claim is:

1. A translational braking device used during a projectile's trajectory comprising at least two airbrakes that are radially deployable so as to increase the projectile's aerodynamic drag, wherein each airbrake is a C-shaped flap having an abutment heel and an end that pivots around a pivot integral with said projectile and parallel to its axis.

2. A translational braking device according to claim 1, wherein said translational braking device incorporates at least one pyrotechnic piston locking at least one said flap in a folded position.

3. A translational braking device according to claim 2, wherein at least two of said flaps are stacked one on top of the other in a folded position, and wherein at least a first of at least said two of said flaps incorporates means to retain the second of at least two of said flaps in a folded position.

4. A translational braking device according to claim 3, wherein said translational braking device incorporates at least four of said flaps, a first flap being locked by said at least one pyrotechnic piston and carrying a first pin retaining a second flap in a folded position, a third flap carrying a second pin co-operating with a first retention surface integral with said second flap, a fourth flap carrying a third pin co-operating with a second retention surface integral with said third flap, at least one pyrotechnic piston locking the at least four said flaps.

5. A translational braking device according to claim 1, wherein each said flap has an external profile covering the arc of a circle whose diameter is substantially equal to that of an external part of said projectile and an indent intended to allow said flap to fold around an axial support integral with said projectile.

6. A translational braking device according to claim 3, wherein each said flap has an external profile covering the arc of a circle whose diameter is substantially equal to that of an external part of said projectile and an indent intended to allow said flap to fold around an axial support integral with said projectile.

7. A translational braking device according to claim 4, wherein each said flap has an external profile covering the arc of a circle whose diameter is substantially equal to that of an external part of said projectile and an indent intended to allow said flap to fold around an axial support integral with said projectile.

8. A translational braking device according to claim 4, wherein each said flap incorporates an abutment heel intended to co-operate with a matching surface of an axial support so as to stop an opening movement of said flap.

9. A translational braking device according to claim 5, wherein each said flap incorporates an abutment heel intended to co-operate with a matching surface of said axial support so as to stop an opening movement of said flap.

10. A translational braking device according to claim 6, wherein said arc length of the external profile of each said flap and the length of a corresponding abutment heel are selected such that, in the deployed position, a free end of at least one said flap presses on an adjacent flap or else on said projectile.

11. A translational braking device according to claim 7, wherein said axial support carries two plates, a lower plate and an upper plate, each plate supporting at least two said pivots arranged between said two plates when said flaps are in the folded position.

12. A translational braking device according to claim 1, wherein each said flap incorporates a toothed circular portion arranged around an end of each said flap, said toothed circular portion meshing with a central pinion having at least a partially toothed perimeter and being coaxial to the projectile, said central pinion thereby joining together said flaps.

13. A translational braking device according to claim 2, wherein each said flap incorporates a toothed circular portion arranged around an end of each said flap, said toothed circular portion meshing with a central pinion having at least a partially toothed perimeter and being coaxial to said projectile, said central pinion thereby joining together said flaps.

14. A translational braking device according to claim 2, wherein said pyrotechnic piston locks a central pinion.

15. A translational braking device according to claim 11, wherein said pyrotechnic piston locks a central pinion.

16. A translational braking device according to claim 3, wherein each said flap is integral with a nose cone fuse of the projectile.

17. A translational braking device according to claim 4, wherein each said flap is integral with a nose cone fuse of said projectile.

18. A translational braking device according to claim 5, wherein each said flap is integral with a nose cone fuse of said projectile.

19. A translational braking device used during a projectile's trajectory comprising at least two airbrakes that are radially deployable so as to increase the projectile's aerodynamic drag, wherein each airbrake is a flap pivoting around a pivot integral with said projectile and parallel to its axis, and each said flap has an external profile covering the arc of a circle whole diameter is substantially equal to that of an external part of said projectile and an indent intended to allow said flap to fold around an axial support integral with said projectile.

* * * * *